US005813927A

United States Patent [19]

Anglea

[11] Patent Number: 5,813,927

[45] Date of Patent: Sep. 29, 1998

[54] DEVICE USED TO SUPPORT BASEBALLS DURING BATTING PRACTICE

[75] Inventor: James H. Anglea, Arlington, Tex.

[73] Assignee: Anglea Turf Concepts, Inc., Arlington, Tex.

[21] Appl. No.: 534,282

[22] Filed: Sep. 27, 1995

[51] Int. Cl.[6] ..... A63B 69/00

[52] U.S. Cl. ..... 473/451; 248/156

[58] Field of Search ..... 473/451, 454; 248/121, 156, 158; 211/133

[56] References Cited

U.S. PATENT DOCUMENTS

| | | | |
|---|---|---|---|
| 1,666,293 | 4/1928 | Lorton | 248/156 |
| 1,769,430 | 7/1930 | Henke | 248/156 |
| 3,219,195 | 11/1965 | Mize | 248/156 |
| 3,255,986 | 6/1966 | Eadie | 248/156 |
| 3,288,305 | 11/1966 | Bryant et al. | 248/156 |
| 3,530,995 | 9/1970 | Tremper | 248/156 |
| 3,675,783 | 7/1972 | Reese | 248/156 |
| 5,197,613 | 3/1993 | Kotlowski | 211/133 |

*Primary Examiner*—Mark S. Graham
*Attorney, Agent, or Firm*—Harry C. Post, III

[57] ABSTRACT

A device to support baseballs used by a pitcher during batting practice. The devices comprises a container for supporting a quantity of baseballs. An upright support member supports the container above a baseball field. Detachable connecting apparatus detachably connects the container to the upright support member. An anchor device is connected to the upright support member for securing the upright support member at a location permitting the pitcher to retrieve a baseball from the container to throw during batting practice.

6 Claims, 2 Drawing Sheets

DEVICE USED TO SUPPORT BASEBALLS DURING BATTING PRACTICE

TECHNICAL FIELD

This invention relates to a device used to support baseballs for a pitcher's use during batting practice and, more especially, to a device used to support baseballs for a pitcher's use during batting practice that has a detachable container and is of a convenient height for a pitcher throwing the baseballs.

BACKGROUND ART

Batting practice normally takes place when a pitcher throws a baseball from the pitcher's mound on the baseball playing field toward the home plate where the batter is located before or after a game. A quantity of baseballs is provided at the pitcher's mound for the pitcher's use during practice. Should the batter miss the pitch, the ball is thrown back to the pitcher. Should the batter hit the pitch, the balls are retrieved and then thrown to the pitcher's mound or collected at the center field. When thrown to the pitcher's mound, batting practice is interrupted while the ball is placed with the quantity of baseballs at the pitcher's mound. When collected at the center field, batting practice is interrupted when the pitcher runs out of baseballs.

The baseballs collected at center field are sometimes carried to the pitcher's mound in an discarded pail or bucket, such as a paint bucket, and the bucket of baseballs is placed near the pitcher's mound. Of course, it is difficult to find a discarded pail or bucket to carry the baseballs and this will delay the batting practice. Sometimes, the pail or bucket is set on a chair near the pitcher's mound. However in any case, the pitcher has to bend over to retrieve a ball from the pail or bucket, which can cause a sore back or muscle problem for the pitcher.

A device has been used during batting practice that has a container with a flat-bottom and four vertically extending sidewalls welded together. A metal pole is welded to the bottom of the container to support it above the surface of the playing field. After the pole is driven into the ground near the pitcher's mound, the container is filled with baseballs and the pitcher takes a ball from the container to replace a ball that was hit by the batter. Since the container is fixed to the pole driven into the ground, the baseballs must be retrieved and carried to the pitcher's mound from where they have been retrieved or thrown to the pitcher's mound, thereby, unduly interrupting the batting practice. Further, driving the pole into the playing field causes severe damage to the field, which requires repair and delay of a game if done immediately prior to the game. Accordingly, it is not desirable to move the pole once it is driven into the ground, even though a right handed pitcher is being replaced with a left handed pitcher, which makes it difficult for the second pitcher to take a baseball from this prior art container.

Accordingly, it is an object of the present invention to provide a device to support baseballs for a pitcher during batting practice that employs an upright support member, a container supporting a quantity of baseballs, apparatus to detachably connect the container to the support member, and an anchor connected to the support member that minimizes damage to the playing field.

Further, it is an object of the present invention to provide a device used to support baseballs for a pitcher during batting practice employing at least one container that can be carried to a baseball collection location, such as the center field, returned to a position near the pitcher's mound after being filled and connected to an upright support member.

Further, it is an object of the present invention to provide a device used to support baseballs for a pitcher during batting practice that employs a support member and at least one container that is detachably connected to the support member, the support member being at a height that allows the pitcher to retrieve a baseball from the container without the pitcher bending over.

DISCLOSURE OF THE INVENTION

In accordance with the present invention there is provided a device to support baseballs used by a pitcher during batting practice. The device comprises a container for supporting a quantity of baseballs. An upright support member supports the container above a baseball field. The container is detachably connected to the upright support member by detachable connecting apparatus. And anchoring apparatus is to the upright support member to secure the upright support member at a location permitting the pitcher to retrieve a baseball from the container to throw during batting practice.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
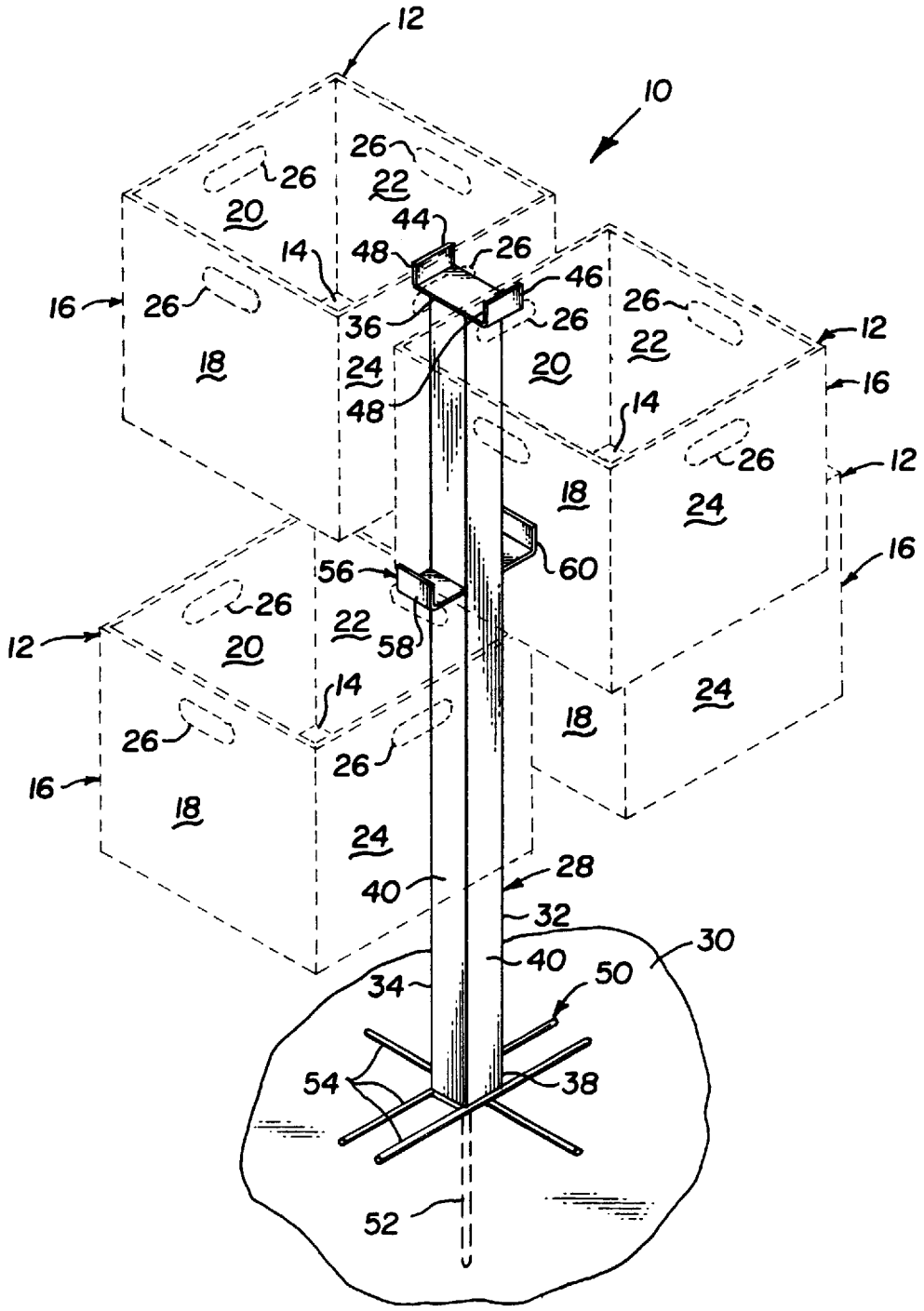
FIG. 1 is a perspective view of a device used to support a quantity of baseballs during batting practice constructed according to the present invention.
Figure 2:
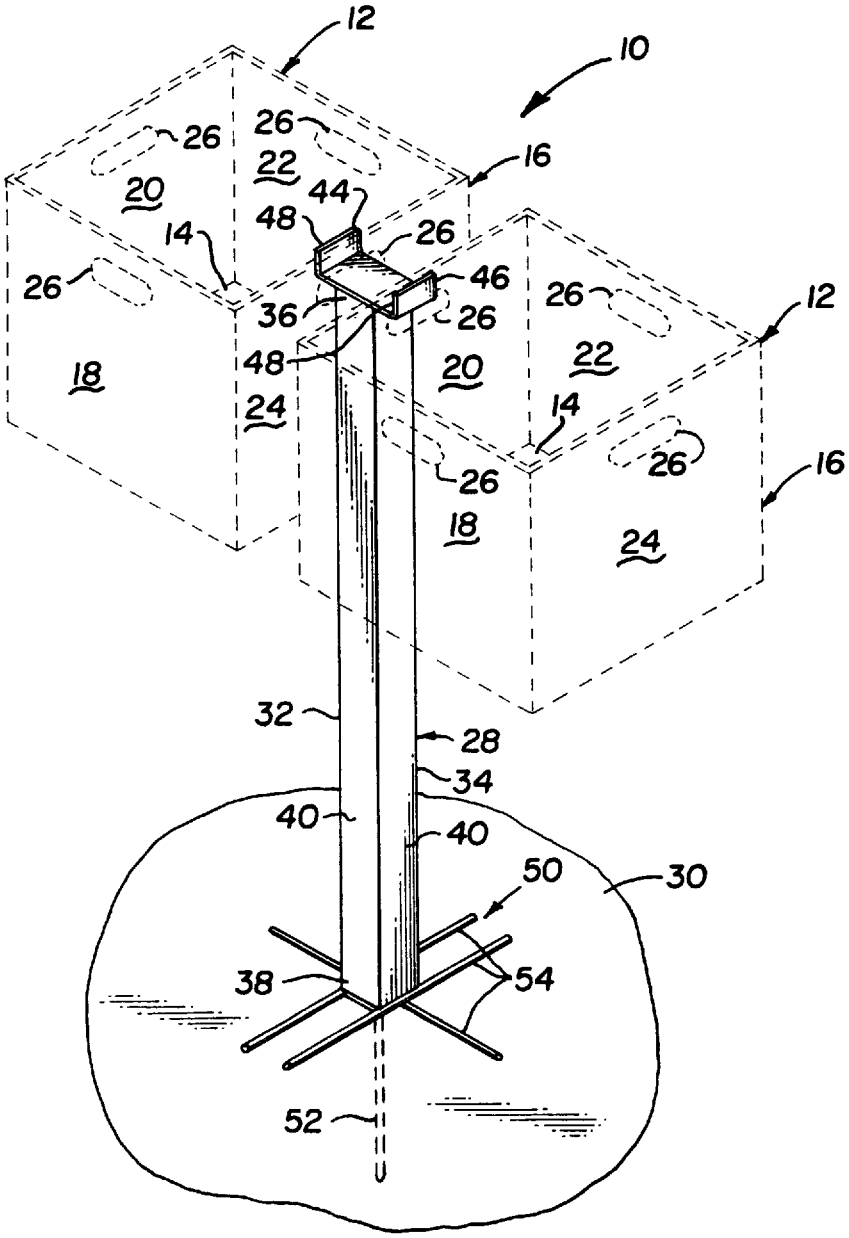
FIG. 2 is a perspective view of a modification of the device shown in FIG. 1.

Now turning to FIGS. 1 and 2, there is shown a device 10, constructed according to the present invention, to support baseballs used by a pitcher during batting practice.

Device 10 uses at least one container 12 to support a quantity of baseballs. The invention shown in FIG. 1 uses up to four containers and the modification of the invention shown in FIG. 2 uses up to two containers.

Each container 12 shown in FIGS. 1 and 2 resembles a milk carton and has a bottom 14 and a lattice style framework 16 disposed along the outer periphery of bottom 14. Framework 16 is composed of rectilinear sidewalls 18, 20, 22 and 24 that are connected to one another and to bottom 14. Rectilinear sidewalls 18, 20, 22 and 24 extend transversely to and upwardly from bottom 14. To permit an individual to carry container 12, an opening 26 is defined in and extends through each sidewall 18, 20, 22 and 24 so that an individual can extend a portion of his hand and grasp the respective sidewall 18, 20, 22 and 24.

Elongated upright support apparatus 28 supports containers 12 above a baseball field 30, which is located near the pitcher's mound during batting practice. Upright support apparatus 28 includes an elongated member 32 that has a tubular body 34. Tubular body 34 has a first end 36, a second end 38 and a shoulder 40 acting against a sidewall 18, 20, 22 or 24 of container 12. Shoulder 40 is substantially planar wall formed by a substantially square two inch cross-section when viewed from first end 36 toward second end 38 or conversely.

First end 36 is disposed away from second end 38 by a distance sufficient to position two upper containers 12 above baseball field 30 so that the pitcher can retrieve a baseball from containers 12 without bending. It has been that no significant bending is required for teenagers when the distance between first end 36 and second end 38 of tubular body 34 of upright support apparatus 28 is approximately or about 32 inches and for adults when the distance between first end 36 and second end 38 of tubular body 34 of upright support apparatus 28 is approximately or about 39 inches.

An upper detachable connecting apparatus 42 is connected to support apparatus 28 for detachably connecting container 12 to support apparatus 28. Upper detachable connecting apparatus 42 includes a first L-shaped member 44 connected to first end 36 of tubular body 34 of upright support apparatus 28 and a second L-shaped member 46 connected to first end 36 of tubular body 34 of upright support apparatus 28. First L-shaped member 44 is connected to a first side of tubular body 34 and second L-shaped member 46 is connected to a second side of tubular body 34 so that the second side is diametrically opposed to the first side where first L-shaped member 44 is connected.

First L-shaped member 44 and second L-shaped member 46 are connected to first end 36 of tubular body 34 with an extension 48 of the "L" directed upwardly or away from end 38. Containers 12 are detachably connected to upper apparatus 42 by positioning extension 48 through opening 26 of a container 12 and allowing a sidewall 18, 20, 22 or 24 of the respective container 12 to engage with L-shaped member 44 or 46 and bottom 14 to move into engagement with shoulder 40. It has been discovered that containers 12 are properly connected and supported when upwardly directed extension 48 has a length of approximately or about 1 inch.

An anchor 50 is connected to upright support apparatus 28 for securing support apparatus 28 at a location permitting the pitcher to easily retrieve a baseball from container 12 to throw during batting practice. Anchor 50 includes a relatively thin diameter cylindrical stake 52 connected to and extending outwardly of second end 38 of upright support member 32 and a plurality of lateral support members 54 extending away from second end 38 of upright support apparatus 28 in a direction substantially parallel to the surface of baseball field 30. It has been discovered that severe damage does not occur to playing field 30 and upright support apparatus 28 does not easily tip over when stake 52 is made of steel reinforcement bar used in concrete with a length of eight and one quarter inches and lateral support members 54 are made of steel reinforcement bar with a length of twelve inches.

A lower detachable connecting apparatus 56 may be used as shown in FIG. 1 and is connected to support apparatus 28 intermediate first end 36 and second end 38 for detachably connecting two more containers 12 to upright support apparatus 28. Lower detachable connecting apparatus 56 is connected to upright support apparatus 28 at a distance away from the upper detachable connecting apparatus 42 sufficient to receive containers 12 on third and fourth L-shaped members 58 and 60, respectively, without contacting the two upper containers 12 supported on first and second L-shaped members 44 and 46, respectively. Lower detachable connecting apparatus 56 includes a third L-shaped member 58 connected to a third side of tubular body 34 of upright support apparatus 28 and a fourth L-shaped member 60 connected to a fourth side of tubular body 34 of upright support apparatus 28. The third and fourth sides of tubular body 34 are diametrically opposed to one another. Third L-shaped member 58 is disposed substantially equidistant between first L-shaped member 44 and second L-shaped member 46, while fourth L-shaped member 60 is disposed substantially equidistant between second L-shaped member 46 and first L-shaped member 44. As previously explained described in relation to first and second L-shaped members 44 and 46, respectively, containers 12 are properly connected and supported when upwardly directed extension 48 of third and fourth L-shaped members 58 and 60, respectively, has a length of approximately or about 1 inch.

In operation, when batting practice is about to begin, an upright support apparatus 28 with a correct length for the age group taking the batting practice is chosen. The chosen upright support apparatus 28 is carried to the selected location near the pitcher's mound on baseball playing field 30 and anchor 50 is driven into playing field 30 at the selected location with lateral support members 54 contacting the surface of playing field 30. A number of containers 12 filled with a quantity of baseballs are taken to the location where apparatus 28 is positioned. Opening 26 in each container 12 is aligned with a respective upright extension 48 of an L-shaped member 44, 46, 58 and 60 and mounted on upright support apparatus 28. The pitcher proceeds to throw the baseballs toward home plate and the batters practice by attempting to hit the thrown ball. If desired, a number of containers 12 may be taken to the outfield and as the hit baseballs are recovered, these empty containers 12 are filed. When containers 12 near the pitcher's mound are emptied, the emptied containers are quickly removed from apparatus 28 and quickly replaced with filled containers 12. At the conclusion of the batting practice, the baseballs may be left in the containers for storage and be ready for use at the next batting practice.

The invention having been described, what is claimed is:

1. A device to support baseballs used by a pitcher during batting practice, comprising: container means for supporting a quantity of baseballs; an upright support means for supporting said container means above a baseball field, said upright support means including an elongated member having a first end and a second end, the first end being disposed away from the second end by a distance sufficient to position said container means above the baseball field for the pitcher to retrieve a baseball from said container means without bending; detachable connecting means for detachably connecting said container means to said upright support means, said detachable connecting means including first and second L-shaped members connected to and on diametrically opposed sides at the first end of the elongated member of said upright support means, third and fourth L-shaped members connected to and on diametrically opposed sides of said upright support means intermediate of the first and second ends, and the third L-shaped member being disposed substantially equidistant between the first and second L-shaped members and the fourth L-shaped member being disposed substantially equidistant between the second and first L-shaped members; and said container means including a carton for the first, second, third and fourth L-shaped members, each carton having a bottom, a plurality of sidewalls extending upwardly from the bottom, and connected to the bottom and to one another, and at least one of the plurality of sidewalls defining an opening through which a portion of the L-shaped members is passed and through which an individual can extend a portion of a hand to grasp the sidewall; and the third and fourth L-shaped members being connected to said upright support means at a distance away from the first and second L-shaped members sufficient to receive the cartons for the third and fourth L-shaped members without contact with the cartons for the first and second L-shaped members; and anchor means connected to said upright support means for securing said upright support means at a location permitting the pitcher to retrieve a baseball from said container means to throw during batting practice.

2. A device as set forth in claim 1, further comprising: said upright support means including an elongated tubular member having substantially walls with a square cross-section for acting against one of the sidewalls included on each of said container means.

3. A device as set forth in claim 1, further comprising: said anchor means including a stake connected to and extending outwardly of the second end of said upright support member and a plurality of lateral support members extending away from the second end of said upright support means in a direction substantially parallel to the surface of the baseball field.

4. A device to support baseballs used by a pitcher during batting practice, comprising: container means for supporting a quantity of baseballs, said container means including a carton having a bottom and a plurality of sidewalls extending upwardly from the bottom and connected to the bottom and to one another, at least one of the plurality of sidewalls defining an opening through which an individual can extend a portion of a hand to grasp the sidewall; an upright support means for supporting said container means above a baseball field, said upright support means including an elongated member having a tubular body with a first end, a second end and a substantially square cross-section, the first end being disposed away from the second end by a distance sufficient to position said container means above the baseball field for the pitcher to retrieve a baseball from said container means without bending; detachable connecting means for detachably connecting said container means to said upright support means, said detachable connecting means including first and second L-shaped members connected to and on diametrically opposed sides at the first end of the tubular body of said upright support means, third and fourth L-shaped members connected to and on diametrically opposed sides of said upright support means intermediate of the first and second ends, and the third L-shaped member being disposed substantially equidistant between the first and second L-shaped members and the fourth L-shaped member being disposed substantially equidistant between the second and first L-shaped members; and said container means including a carton for the first, second, third and fourth L-shaped members, each carton having a bottom, a plurality of sidewalls extending upwardly from the bottom, and connected to the bottom and to one another, and at least one of the plurality of sidewalls defining an opening through which a portion of the L-shaped member is passed and through which an individual can extend a portion of a hand to grasp the sidewall; the third and fourth L-shaped members being connected to said upright support means at a distance away from the first and second L-shaped members sufficient to receive the cartons for the third and fourth L-shaped members without contact with the cartons for the first and second L-shaped members; and anchor means connected to said upright support means for securing said upright support means at a location permitting the pitcher to retrieve a baseball from said container means to throw during batting practice, said anchor means including a stake connected to and extending outwardly of the second end of said upright support member and a plurality of lateral support members extending away from the second end of said upright support means in a direction substantially parallel to the surface of the baseball field.

5. A device as set forth in claim 4, further comprising: the distance between the first end and the second end of the tubular body of said upright support means being approximately 32 inches.

6. A device as set forth in claim 4, further comprising: the distance between the first end and the second end of the tubular body of said upright support means being approximately 39 inches.

* * * * *